United States Patent [19]

Warncke

[11] 4,253,454

[45] Mar. 3, 1981

[54] RESPIRATOR PACKAGE FOR CARRYING ON A PERSON

[75] Inventor: Ernst Warncke, Lübeck, Fed. Rep. of Germany

[73] Assignee: Drägerwerk Aktiengesellschaft, Fed. Rep. of Germany

[21] Appl. No.: 41,791

[22] Filed: May 23, 1979

Related U.S. Application Data

[63] Continuation of Ser. No. 839,578, Oct. 5, 1977, abandoned.

[30] Foreign Application Priority Data

Oct. 5, 1976 [DE] Fed. Rep. of Germany ..... 2644806

[51] Int. Cl.[3] ..... A62B 7/00

[52] U.S. Cl. ..... 128/202.26; 128/204.15; 128/205.22

[58] Field of Search ..... 128/205.22, 201.27, 128/202.14, 202.19, 202.26, 205.12, 205.28, 204.15

[56] References Cited

U.S. PATENT DOCUMENTS

| | | | |
|---|---|---|---|
| 244,062 | 7/1881 | Khotinsky | 128/191 R |
| 771,801 | 10/1904 | Andrew | 128/202.19 X |
| 1,185,392 | 5/1916 | Ganzer | 128/202.19 |
| 2,380,372 | 7/1945 | Alderfer | 128/205.22 X |
| 3,208,449 | 9/1965 | Bartlett, Jr. | 128/142 R |
| 3,338,238 | 8/1967 | Warncke | 128/203 X |

FOREIGN PATENT DOCUMENTS

| | | | |
|---|---|---|---|
| 615890 | 6/1933 | Fed. Rep. of Germany | 128/205.12 |
| 891497 | 8/1953 | Fed. Rep. of Germany | 128/142 R |
| 971689 | 2/1959 | Fed. Rep. of Germany | 128/205.22 |
| 803484 | 10/1936 | France | 128/191 R |
| 557112 | 2/1957 | Italy | 128/147 |

*Primary Examiner*—Henry J. Recla
*Attorney, Agent, or Firm*—John J. McGlew

[57] ABSTRACT

A respirator package for carrying on a person includes a tubular frame which forms a container for a high pressure gas such as oxygen. A respiratory air circulating system is adapted to be mounted on the frame and connected to the high pressure gas therein for the selected circulation of the gas and respiratory air to and from the wearer and also advantageously includes means for regenerating the breathing air and supplementing it with the gas such as oxygen. The high pressure gas container comprises a frame made up of successive windings of a tube to form a closed container having a connecting valve associated therewith. The frame thus formed is advantageously provided with straps so that the frame can be carried on a wearer's back and it provides a spacing and insulation for a breathing system which advantageously includes a regenerator which is likely to heat during operation. The parts of the system are held in place on the frame by means of a casing which is secured to the frame.

3 Claims, 3 Drawing Figures

RESPIRATOR PACKAGE FOR CARRYING ON A PERSON

This is a continuation of application Ser. No. 839,578 filed Oct. 5, 1977, now abandoned.

BACKGROUND OF THE INVENTION

1. Field of the Invention

The invention relates in general to respirators and in particular to a new and useful respirator with means for the circulation of the respiratory air including a coiled high-pressure tube as pressure gas tank.

2. Description of the Prior Art

Respirators, including those with circulation of the respiratory air, are worn by the user always under especially unpleasant circumstances. They are to enable him to stay and to perform physical work in an unbreathable environmental atmosphere over a long period of time. The work to be performed is heavy. The passageways to be gone through, as for example in mining, are often narrow and low. The respirators must therefore be light weight, small, and convenient to carry.

A known circulation respirator having means for the regeneration of the respiratory air contains in a respirator housing, as a built-in element, an oxygen tank consisting of a high-pressure tube which is coiled transverse to its longitudinal axis in the manner of a volute spring, so that the form of a spiral among others, may result. It is further curved in the longitudinal axis, so that it hugs the back plate of the housing. In front of the oxygen tank a respiratory pouch is provided. The regeneration cartridge is located in the respirator housing above the oxygen tank. It is thus arranged in the housing directly opposite the wearer's back. Thereby the temperature drop occuring upon expansion of the oxygen is not utilized for cooling the regeneration cartridge, which may in use heat up to about 100° C. The circulation respirator is worn with a strap device fastened to the housing, although this is not shown. While this device is flat, it is very long because of the arrangement of the regeneration cartridge above the oxygen tank. Very disadvantageous is the above-mentioned missing heat protection, and not even some other insulation is provided (German Pat. No. 615,890).

Another respirator has a compressed gas storage tank designed as a flat part. This involves an injector, with which the outside air a drawn in for respiration. The injector is operated with gas from the compressed gas storage tank.

The tank comprises either individual smaller pressure gas vessels which are connected together by connecting pipes, or two sheet metal plates welded together, both provided with inter-connected indentations which after the welding together form communicating compressed gas storage chambers. The sheet metal plates as well as the individual small pressure gas vessels may be adapted to the wearer's body form. The other controls, such as the injector, pressure reducer, etc., may be disposed in part on one and in part on the other side of the compressed gas storage tank. The tank, which is flat, may be designed as a carrying frame. The carrying straps may be attached to it directly. The first named design of the compressed gas storage tank is very expensive because of the connecting pipes. For the attachment of the carrying straps, a special carrying frame is necessary, The realization of the compressed gas storage tank from the welded plates is not feasible in a profitable quantity with respect to manufacturing technique, for if the high pressure is not to affect the individual cavities, the weld between them must be gas-tight, to withstand the relatively high pressure. The use of this compressed gas storage tank in a circulation respirator, that is, including those with a regeneration cartridge, is not solved, and no solution is visible from the arrangement (German Pat. No. 971,689).

SUMMARY OF THE INVENTION

It is the object of the invention to make a respirator with circulation of the respiratory air small, and which is light-weight, and has protection from heat from the regeneration cartridge.

According to the invention the pressure gas tank is bent as a pressure tube system and, removable as a basic frame, is connected with a protective casing which contains the elements respiratory pouch, regeneration cartridge, pressure reducer and automatic lung control with the connecting elements, and by its upper part the pressure tube system shields the regeneration cartridge relative to the wearer.

The advantages attained with the invention consist in particular in that the respirator can be made small and light. With its flat form and the adaptation to the wearer the pressure tube system requires much less space than the pressure gas bottle used heretofore and also the known models made of pressure tubes. Moreover, the hitherto necessary bottom of the respirator housing, which is bulky is eliminated. The temperature drop occurring when gas is dispensed and during the resulting expansion cools the compressed gas tank. By the arrangement of the regeneration cartridge which is very warm with respect to the wearer, the heat of the cartridge is kept away from the wearer and thereby his heavy work is made easier.

As a variant of the invention, shoulder straps and bottom straps are attached to an outer tube of the pressure gas tank. The advantageous direct attachment of the carrying straps on the tank as a basic element of the respirator further contributes to a small and light respirator.

The same effect is obtained when the pressure tube system comprises a plurality of single tubes which are combined in a bus strip and connected with one another.

Accordingly it is an object of the invention to provide a respirator package which is adapted to be carried on the back of a person which comprises a tube structure forming a backing frame and adapted to contain a high pressure gas such as oxygen and a respiratory system mounted on the backing frame which includes a pressure reducer, breathing air regenerator cartridge and air and pressure gas controls for the selective circulation of the breathing gas and the pressure gas to and from the user and for the regeneration of the breathing air and further including a casing extending over the respiratory system and connected to said backing frame.

A further object of the invention is to provide a backing frame comprising a tubular structure forming a container for a high pressure gas having strap means thereon for mounting said container on the back of a person.

A further object of the invention is to provide a respirator package which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

GENERAL DESCRIPTION OF PREFERRED EMBODIMENTS

Figure 2:
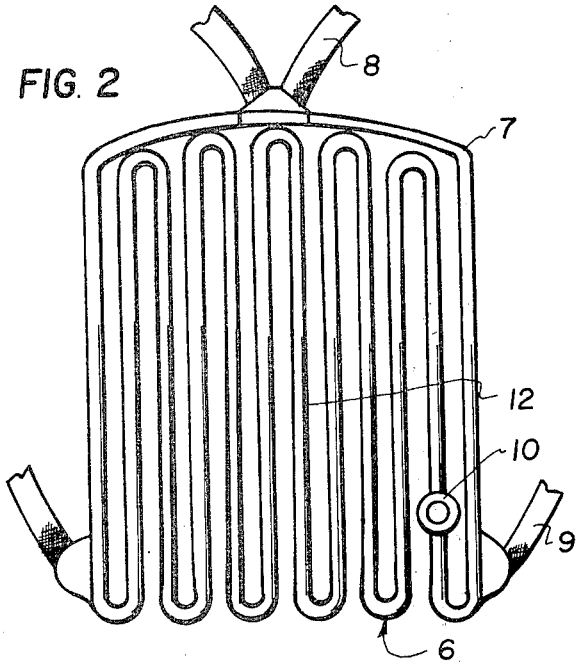
FIG. 2 is a rear elevational view of a tube structure backing frame and pressure gas container used in the respirator package shown in FIG. 1.
Figure 1:
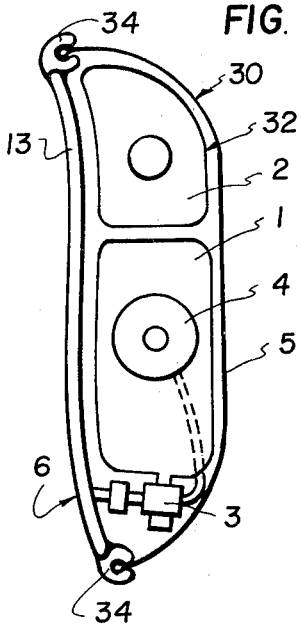
FIG. 1 is a schematic longitudinal sectional view of a respirator package constructed in accordance with the invention.

Referring to the Drawings in particular, the invention embodied therein comprises a respirator package generally designated 30 which comprises a tube structure 12 forming a backing frame and a high pressure gas tank generally designated 6 and a respiratory system generally designated 32 which is mounted on and secured to the backing frame and is covered by a casing or cover 5 which is connected to the backing frame 6 by connecting brackets 34.

The respiratory system 32 provides for the circulation of respiratory air and pressure gas from the tank 6 to and from the wearer and also for the regeneration of the breathing air by passage through a regenerator 2 and a pouch 1 for the control of the air with pressure gas which is fed through a pressure reducer and an automatic lock control 4.

In accordance with the invention the pressure gas tank 6 which is designed as the pressure tube system 12 forms the basic frame of the respirator. It is advantageously shaped to the back of the wearer and contains all of the other respiratory system elements 32 within a protective casing 5.

A feature of the construction is that because the regenerator 2 is located in the upper portion of the casing 5 and is shielded from the back of the wearer by the frame construction of the gas tank 6 there is a protection of the back of the wearer from this heating up which takes place. Bracket 34 which permits connection of the gas tank 6 to the casing 5 permit the easy removal of the casing 5 for recharging purposes or for replacement.

Figure 3:
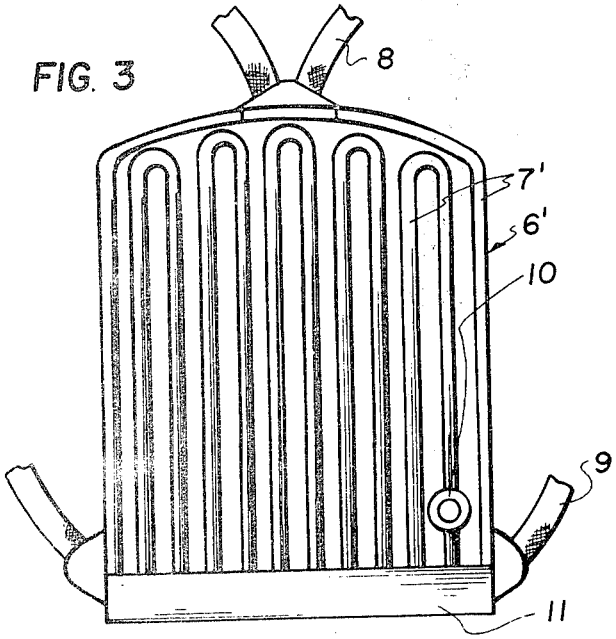
FIG. 3 is a view similar to FIG. 2 of another embodiment of the invention.

In the embodiment shown in FIG. 3 gas tank or pressure tank 6' does not comprise a single oil tube such as the tube 7 of FIG. 2 but instead comprises a frame or grid structure made up of a plurality of individual tubes 7' which connect to a bus strip or header 11. Shoulder straps 8 and lower straps 9 are connected to each of the frames 6, 6' shown in the embodiments of FIGS. 2 and 3. The bus strip is of advantage when the lower portion of the frame 6 or 6' is adapted to be subjected to information or torsion.

While specific embodiments of the invention have been shown and described in detail to illustrate the application of the principles of the invention, it will be understood that the invention may be embodied otherwise without departing from such principles.

What is claimed is:

1. A combination backing frame and high pressure tank forming a shoulder mounting for carrying on the back of a person to receive breathing gas, comprising a tubular frame structure forming a backing frame adapted to contain a high pressure breathing gas for the person and to produce a cooling effect when the breathing gas is released from the frame, said backing frame having one side conformable to the person's back and adapted to overlie the person's back and having an opposite rear side, a casing connected to said frame and covering said rear side, the space between said casing and said backing frame forming a receiving chamber, said tubular frame structure comprising a single coil tube formed into a rectangular grid, a heat producing breathing gas regenerator for producing breathing gas for the person and which produces heat with the production of the breathing gas connected to said high pressure tank and positioned inside and near the top of said chamber on a side of said tubular frame away from said one side thereof conformable to the person's back, said tubular frame positioned to physically separate said heat producing breathing air regenerator from the person's back and by the cooling of said frame to counteract the heating of said regenerator to prevent a heating of the person's back.

2. A combination backing frame and high pressure tank forming a shoulder mounting for carrying on the back of a person to receive breathing gas, comprising a tubular frame structure forming a backing frame which is adapted to contain a high pressure breathing gas for the person and to produce a cooling effect when the breathing gas is released from the frame, said backing frame having one side conformable to the person's back and adapted to overlie the person's back and having an opposite rear side, a housing connected to said frame and covering said rear side, the space between said casing and said backing frame forming a receiving chamber, said tubular frame structure comprising a plurality of U-shaped tubes and a cross header forming a lower portion of said tubes interconnecting said tubes, a heat producing breathing gas regenerator for producing breathing gas for the person and which produces heat with the production of breathing gas connected to said high pressure tank and positioned inside and near the top of said chamber on a side of said tubular frame away from said one side thereof conformable to the person's back, said tubular frame positioned to physically separate said heat producing breathing gas regenerator from the person's back and by the cooling of said frame to counteract the heating of said regenerator to prevent the heating of the person's back.

3. A method of preventing the heating of a person's back who is carrying a heat producing breathing air regenerator connected to a tubular frame structure for containing a high pressure breathing gas for the person and which produces a cooling effect when the breathing gas is released from the frame, comprising, forming the tubular frame into a backing frame shaped to conform to the person's back and adapted to overlie the person's back, connecting a casing to the tubular frame to define a receiving chamber therebetween, positioning the heat producing breathing gas regenerator within the receiving chamber and connecting the regenerator to the tubular frame so that the tubular frame is positioned to physically separate the person's back from the regenerator, and withdrawing breathing gas from the tubular frame and regenerator which produces the cooling effect on the tubular frame and a heating effect on the regenerator, whereby the cooling effect of the tubular frame counteracts the heating effect of the regenerator and prevents the heating of the person's back.

* * * * *